US005261943A

United States Patent [19]

Friedrichs et al.

[11] Patent Number: 5,261,943

[45] Date of Patent: Nov. 16, 1993

[54] METHOD AND APPARATUS FOR THE EXTRACTION OF METALS FROM METAL-CONTAINING RAW MATERIALS

[75] Inventors: Hans A. Friedrichs, Solingen; Leonid W. Ronkow, Herzogenrath, both of Fed. Rep. of Germany

[73] Assignee: Vereinigte Aluminium-Werke A.G., Bonn, Fed. Rep. of Germany

[21] Appl. No.: 807,016

[22] Filed: Dec. 10, 1991

[30] Foreign Application Priority Data

Dec. 11, 1990 [DE] Fed. Rep. of Germany ..... 4039504

[51] Int. Cl.[5] ..... C21B 11/06

[52] U.S. Cl. ..... 75/482; 75/677; 266/173

[58] Field of Search ..... 75/606, 616, 617, 657, 75/677, 482; 266/173

[56] References Cited

U.S. PATENT DOCUMENTS

| | | | |
|---|---|---|---|
| 3,216,820 | 11/1965 | Phillips | 75/677 |
| 3,323,909 | 6/1967 | Phillips | 75/677 |
| 4,460,529 | 7/1984 | Schultze et al. | 264/81 |
| 4,547,415 | 10/1985 | Schultze et al. | 428/36 |
| 4,657,794 | 4/1987 | Schultze et al. | 428/36 |

FOREIGN PATENT DOCUMENTS

| | | |
|---|---|---|
| 421411 | 4/1991 | . |
| 2731845 | 1/1979 | Fed. Rep. of Germany . |
| 3145507 | 5/1983 | Fed. Rep. of Germany . |

*Primary Examiner*—Peter D. Rosenberg
*Attorney, Agent, or Firm*—Darby & Darby

[57] ABSTRACT

Metal-containing ores are extracted by a process and apparatus which avoid contaminating the product with fuel gas components. In a rotary kiln, a heat shock-resistant ceramic pipe is subjected to indirect high temperature heating, thereby allowing the extraction reaction to be conducted without heat producing fuel gases.

22 Claims, 1 Drawing Sheet

METHOD AND APPARATUS FOR THE EXTRACTION OF METALS FROM METAL-CONTAINING RAW MATERIALS

FIELD OF THE INVENTION

This invention relates to a method and apparatus for extracting ores (for instance by reduction of chlorination) in an indirectly heated rotary kiln, the kiln comprising a ceramic pipe capable of withstanding temperatures in excess of 1200° C. More particularly, the invention relates to a method for extracting metals or metal derivatives from metal-containing raw materials without substantially adding impurities to the metal or metal derivative.

BACKGROUND OF THE INVENTION

In conventional methods for reducing ores (and for other processes for extracting ores), the heat of reaction and the reactive processing agents (generally reducing agents) are supplied by way of the gas phase. Using these methods, the fuel gases tend to contaminate the product with, for example, the sulfur and phosphorous contained in the fuel gases.

Alternately, indirectly heated rotary kilns have been used. The outer jacket of the rotary kiln is made of a highly alloyed steel containing, for example, cobalt, chromium and nickel. According to the German Offenlegungsschrift 25 26 296, such a furnace can be used for calcining at temperatures up to 1,200° C.

However, the reduction of ores generally requires significantly higher temperatures range in the reducing zone of the rotary kiln. Depending on the starting materials selected and on the reactions desired, the temperatures in the reducing zone generally are between 1,000° and 1,500° C. However, under normal operating conditions, this temperature will be exceeded for brief periods of time. Thus, an apparatus which withstands such extreme temperatures (>1,200° C.) can be very useful for allowing reliable reduction processes that utilize indirect heating.

Under the temperature conditions described, rotary kilns with steel casings cannot be used since their stability decreases rapidly at temperatures above 1,000° C. Further, ceramic linings can improve the abrasion resistance of the steel pipe at high temperatures and, under some circumstances, also reduce caking of material on the wall. However, such linings act as thermal insulators so that the indirect heating process cannot be used.

OBJECT OF THE INVENTION

It is therefore an object of the present invention to provide an improved method for extracting ores in an indirectly heated rotary kiln by a method that allows the continuous production of high purity metal products by reducing or eliminating the use of fuel gases, while nonetheless utilizing reaction temperatures above 1,000° C., preferably above 1,200° C. It is a further object of the invention to provide a rotary kiln for use in the improved method.

SUMMARY OF THE INVENTION

We have found that metals or metal derivatives can be extracted, with high purity, in a continuous process using an indirectly heated rotary kiln comprising a ceramic pipe which is capable of withstanding temperatures in excess of 1200° C. In addition, our process and apparatus reduce or eliminate the use of fuel gases, thereby reducing possible contamination of the extracted metal product.

In a specific embodiment of our invention, the ceramic pipe of the rotary kiln has fine, homogeneously distributed pores and has a layered construction, the layers being produced by plasma spraying. Such a specific ceramic pipe enables the indirect heating of the reaction at temperatures in excess of 1200° C.

DETAILED DESCRIPTION OF THE INVENTION

Figures 1, 2:
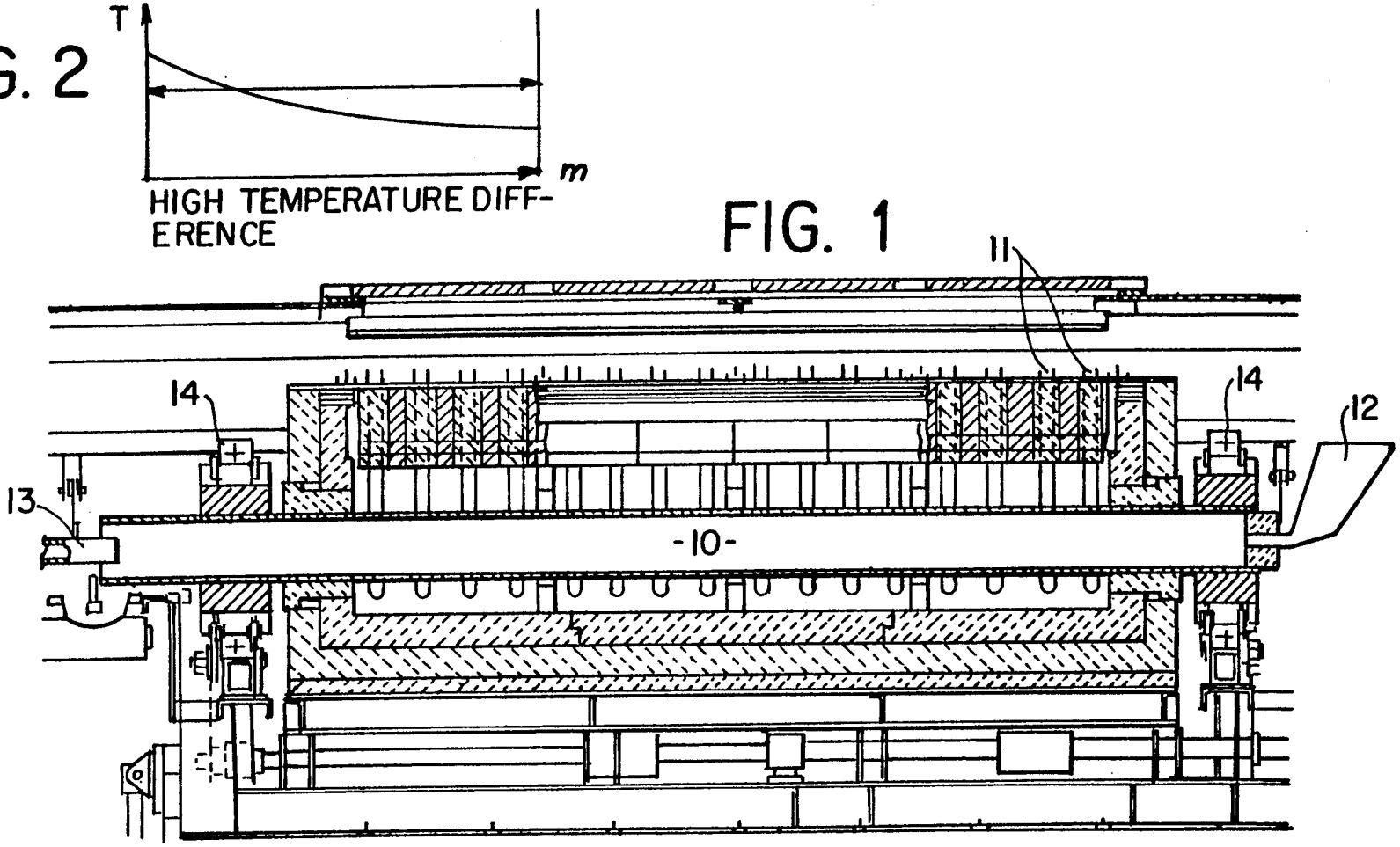
FIG. 1 shows a rotary kiln illustrative of one specific embodiment of the invention.
FIG. 2 is a plot of the temperature gradient along the ceramic pipe between points A and B.

By the present invention, a method is provided to extract metals from metal-containing raw materials without substantially adding impurities, which are contributed by the process itself, to the resulting metal or metal derivative.

It is an important aspect of the invention that the heat of reaction not be substantially supplied by way of the gas phase, but through heat radiation and conduction, generally from external heating devices such as electrical resistance-based heaters. While a gas phase is still used, for instance to supply a reductant, the indirect heating used in the inventive method allows greater control of the gas phase components, thus allowing the desired product quality to be obtained.

Referring to FIG. 1, there is depicted an indirectly heated ceramic rotary kiln in accordance with our invention. As there seen, the kiln comprises a ceramic pipe 10, further described below, which is indirectly heated by, in this embodiment, molybdenum disilicide ($MoSi_2$) 11, which provide external heat. The expression "external heat" in the context of our invention means heat which is not created in the reaction space of the kiln, but which arrives there instead by radiation or conduction. The external, indirect heating can be accomplished using fuel gases (which do not contact the ores) or electrical energy. Basically, temperatures ranging from 500° C. to 1,500° C. can be used. Preferably, the indirectly heated ceramic pipe of the rotary kiln is heated to temperatures above 1,200° C.

In a kiln of the type depicted in FIG. 1, the raw material is introduced into the pipe 10 through filling tube 12 and the reactant gas or gases are introduced into the pipe 10 through gas intake 13. Rotation of the pipe 10 is accomplished by barrel rings 14, as is known in the art of rotary kilns.

In one aspect, the inventive method can be used for the reduction of oxides with gaseous reducing agents, such as hydrogen and carbon monoxide. As non-limiting examples, the oxides of the following metal elements can serve as starting materials: iron, germanium, arsenic, vanadium, niobium, tantalum, molybdenum, tungsten, rhenium, copper, zinc, cobalt and nickel. Suitable, but not limiting further examples of reducing gases include methane, natural gas and mixtures of the mentioned gases.

Also, metals can be extracted from the ores by forming a chloride product. The chlorination is performed under analogous conditions wherein a chlorinating agent is used in place of the reducing agent described above. The method allows the purity of the chloride product to be controlled by minimizing or dispensing with fuel gases.

Non-limiting examples of useful chlorinating agents include chlorine gas, and solid substances, such as $CaCl_2$ which produce chlorine gas by heating. The following are non-limiting examples of oxides which can be converted to very pure chlorides by the method of the invention: MgO (to $MgCl_2$); $TiO_2$ (to $TiCl_4$); $ZnO_2$; and $HfO_2$.

Those of ordinary skill will recognize that the method of the invention can be applied to other ore-extraction processes which involve contacting ore with a gaseous reactant at an elevated temperature.

By the method of the invention, metals, metal chlorides and other metal derivatives which are substantially free of sulfur and phosphorous may be obtained. Preferably, the amount of sulfur in the product is less than about 5 ppm and the amount of phosphorous is less than about 5 ppm. More preferably, the amount of sulfur is less than about 1 ppm, and the amount of phosphorous is less than about 1 ppm.

It is known in prior kilns to use fuel gases in the processes such as those described above to provide the needed temperatures. Such fuel gases include sulfides, peroxides, aldehydes, carbonic products and cracked gases. It is an aspect of our invention that such gases are to be avoided as the mechanism for attaining the desired kiln temperature. It is recognized that the reactant gases used in methods in accordance with our invention may be capable of providing some heat in the kiln. However, such reactant gases can readily be distinguished from fuel gases by those of ordinary skill because: (a) they are capable of effectively reacting with the ore; and (b) they are used in amounts appropriate for use as a reactant. Preferably, the reactant gases are provided in amounts no greater than about 5:1 over the stoichiometric amount, more preferably no more than about 3:1.

In a preferred example, sulfur-free and phosphorus-free iron sponge has been produced by reducing iron ore pellets with carbon monoxide and hydrogen in the absence of fuel gases.

In all the embodiments described, the reaction temperature should be selected to avoid a molten phase in the rotary kiln.

In the trials of the inventive method, no contamination of the reaction materials by the material of the pipe or by the combustion gases was detected. Likewise, caking of material to the wall of the kiln was not observed. The abrasion resistance of the ceramic pipe was considerably better than that of conventional steel pipes.

The material of the ceramic pipe 10 can be produced using a water-stabilized plasma jet by spraying oxide raw materials on a cooled internal mold core. For example, the ceramic pipe has been made using $Al_2O_3$ spinell, and stabilized $ZrO_2$ powders. The individual layers of the sprayed material generally have a thickness of 0.05 to 0.2 mm and a fine, homogeneously distributed porosity. Multiple layers are applied until, preferably, a thickness between about 8 and 12 mm is achieved. The multilayer construction resulted in a stress-free. ceramic body, which showed no cracks or lasting deformations even when subjected to shock-like temperature stresses. Ceramic pipes, with a length of 0.5 to 10 m and an external diameter of 0.1 to 1.5 m can be prepared by this method. Those of ordinary skill will recognize that the respective dimensions should be adapted to the mechanical and thermal stresses anticipated.

A method of making such ceramic pipes is described in U.S. Pat. Nos. 4,460,529, 4,547,415 and 4,657,794, which are hereby incorporated into the specification in their entirety.

Preferably, the ceramic pipe can withstand temperature shocks such as differences between 1100° and room temperature within seconds, more preferably 1100° and room temperature within 2-3 sec.

While not wishing to be restricted by theory, one explanation for the temperature shock-resistance of the pipe is that the pore structure of the ceramic pipe allows the pipe material to rapidly accommodate the stresses created by extreme temperature differences. The pipe can be machined very easily. In a preferred embodiment, the ceramic is produced by plasma spraying particles having an average diameter of between about 1 and 150 microns, more preferably between about 10 and 90 microns. Preferably, the average pore size is between about 10 and 1000 nm, more preferably between 100 and 500 nm.

Referring now to FIG. 2, there is depicted the temperature gradient along the ceramic pipe 10 between the points A and B. As there seen, this gradient must be smooth in order to avoid any step in temperature change.

In abstract theory, the porosity of the pipe material might be expected to allow the reactant gas to escape from the reaction space. In practice, this has not been a problem because the pressure inside and outside the pipe is nearly the same, while porous diffusion is negligible.

The ceramic pipe exemplified can conduct sufficient heat to allow indirect heating. However, those skilled in this art in light of these disclosures, will recognize that ceramic pipes other than that specifically exemplified may be used to achieve a suitable temperature stress-resistant pipe.

What is claimed is:

1. A method for extracting metals from solid, metal-containing raw materials by reacting with a gaseous reactant, said method comprising the steps of:

providing a rotary furnace comprising a ceramic pipe, wherein the ceramic material of said pipe has homogeneously distributed pores;

providing an external heat source;

introducing said raw materials and said gaseous reactant into the reaction space of said furnace; and reacting said raw materials with said reactant to form a product containing said metal.

2. The method of claim 1, wherein the reaction temperature is higher than 1,200° C.

3. The method of claim 1, wherein said ceramic pipe is made by a plasma spraying process.

4. A method for the reduction of ores in a rotary furnace, comprising reacting ores with reductants, wherein heat is supplied to the reaction indirectly and wherein the reaction space of the rotary furnace consists essentially of reactants required for the reduction.

5. The method of claim 4, wherein the reaction temperature is higher than 1,200° C.

6. The method for extracting metals of claim 1, wherein said reacting occurs under conditions wherein substantially all the heat required for said reaction is supplied by said heat source.

7. The method for extracting metals of claim 1, wherein said reaction consists essentially of reactants required for said reaction.

8. The method for extracting metals of claim 7 wherein said gases are introduced into said reaction space in an amount no greater than 5:1 over the stoichiometric amount for reaction with said raw materials.

9. The method for extracting metals of claim 8, wherein said gases are introduced into said reaction space in an amount no greater than 3:1 over the stoichiometric amount for reaction with said raw materials.

10. The method for extracting metals of claim 6, further comprising the step of recovering the metal-containing product of said reaction.

11. The method for extracting metals of claim 10, wherein said metal-containing product is substantially free of sulfur or phosphorus.

12. The method for extracting metals of claim 11, wherein said recovered metal contains less than 5 ppm of sulfur and less than 5 ppm of phosphorus.

13. The method for extracting metals of claim 12, wherein said metal contains less than 1 ppm of sulfur and less than 1 ppm of phosphorus.

14. The method for extracting metals of claim 6, wherein said gaseous reactant is introduced into said reaction space by introducing chlorine gas or a compound which produces chlorine gas upon heating, said raw materials include metal oxides, and said reacting is effective to convert said metal oxides to metal chlorides.

15. The method for extracting metals of claim 14, wherein said oxide is selected from the group consisting of $MgO$, $TiO_2$, $ZnO_2$ and $HfO_2$.

16. The method for extracting metals of claim 6, wherein said gaseous reactant is a reducing agent, and said raw materials comprise a metal oxide.

17. The method for extracting metals of claim 16, wherein said reactant is selected from the group consisting of hydrogen, carbon monoxide, methane, natural gas, and mixtures thereof.

18. The method for extracting metals of claim 16, wherein said metal oxide is selected from the group consisting of iron, germanium, arsenic, vanadium, niobium, tantalum, molybdenum, tungsten, rhenium, copper, zinc, cobalt and nickel.

19. The method for extracting metals of claim 1, wherein said ceramic pipe is a temperature shock-resistant pipe.

20. The method for extracting metals of claim 4, wherein said reacting takes place in a rotary furnace comprising a temperature shock-resistant ceramic pipe, wherein the ceramic material of said pipe has homogeneously distributed pores.

21. The method for extracting metals of claim 20, wherein said gases are introduced into said reaction space in an amount no greater than 5:1 over the stoichiometric amount for reaction with said raw materials.

22. The method for extracting metals of claim 4, wherein said gases are introduced into said reaction space in an amount no greater than 3:1 over the stoichiometric amount for reaction with said raw materials.

* * * * *